United States Patent [19]

Serizawa

[11] 4,007,999

[45] Feb. 15, 1977

[54] FAN ROTOR FOR CROSSFLOW FAN

[75] Inventor: Masakazu Serizawa, Chigasaki, Japan

[73] Assignee: Rokugo Mfg. & Co., Ltd.

[22] Filed: Oct. 2, 1975

[21] Appl. No.: 618,944

[30] Foreign Application Priority Data

Dec. 19, 1974 Japan ..... 49-144988

[52] U.S. Cl. ..... 416/178; 416/187

[51] Int. Cl.[2] ..... F04D 29/28

[58] Field of Search ..... 416/178, 187, 199; 29/156.8 CF

[56] References Cited

UNITED STATES PATENTS

| | | | |
|---|---|---|---|
| 3,154,242 | 10/1964 | Harris | 416/187 X |
| 3,211,364 | 10/1965 | Wentling et al. | 416/178 |

FOREIGN PATENTS OR APPLICATIONS

| | | | |
|---|---|---|---|
| 1,230,880 | 9/1960 | France | 416/178 |
| 1,957,988 | 6/1971 | Germany | 416/178 |
| 586,918 | 12/1958 | Italy | 29/156.8 CF |
| 840,447 | 7/1960 | United Kingdom | 416/178 |

*Primary Examiner*—Everette A. Powell, Jr.
*Attorney, Agent, or Firm*—Amster & Rothstein

[57] ABSTRACT

A fan rotor for a crossflow fan is provided wherein a number of fan rotor units, having an identical or a different length and comprising a set of end discs and intermediate discs facing thereto or a set of intermediate discs confronting each other and a blade drum rigidly connecting said confronting discs, are aligned so that their intermediate discs abut each other and the abutting discs are rigidly secured together by their respective relative movements.

4 Claims, 13 Drawing Figures

FAN ROTOR FOR CROSSFLOW FAN

BACKGROUND OF THE INVENTION

The present invention relates to a fan rotor for a fan, and more particularly to a fan rotor for a crossflow fan.

In the present invention a crossflow fan refers to a fan wherein, as shown in FIGS. 1 and 2 of the attached drawings, a fluid is sucked in through about half of the periphery of a hollow fan rotor 20 in a direction perpendicular to its axis 21, as shown by the arrow X in FIG. 1, and hollow fan rotor 20 having a number of blades 22 on its periphery which are rotated at a constant velocity within a housing passes the liquid through the hollow space of fan rotor 20 and discharges it in the direction Y indicated in FIG. 1 through about half of the periphery of rotor 20 opposite to the above sucking periphery, substantially in the same direction as arrow X.

A crossflow fan having the above constitution is particularly characterized by the property shown in FIG. 2 that the fluid can be sucked into and discharged out of the fan rotor over its entire axial length L so that its efficiency is higher than that of centrifugal fans, axial fans and other fans of the conventional type. However, it is naturally necessary for fan rotor 20 of a crossflow fan to be constructed in such a manner that its axial length L is larger in comparison to its outer diameter D. Accordingly, there arises a problem wherein it is difficult for fan rotor 20 to maintain its mechanical strength against the forces which are applied thereto during its rotation.

Hithereto, few countermeasures for resolving this problem have been proposed, and those available for practical use have not yet been developed. For example, as shown in FIG. 3, one proposed fan rotor incorporates a metal drum 51 provided with a number of blade rows 50, 50', 50'' on its periphery with reinforcing discs 52 and 53 interposed between blade rows 50 and 50' as well as 50' and 50'', respectively, whereby the inner periphery of metal drum 51 and the outer peripheries of reinforcing discs 52, 53 are rigidly fastened by binders 54 and 55 which are firmly wound around the outer periphery of metal drum 51 at reinforcing discs 52, 53. Further, for a fan rotor which has a large length L in the direction of a drive shaft 56, additional mechanical strength can be provided by making the drive shaft 56 pass through central reinforcing discs 52, 53, as shown in FIG. 3. However, it has been found to be very difficult to discover a manufacturing technique which could surely and rigidly secure metal drum 51 to reinforcing discs 52, 53 as well as both end discs 57, 57' by means of binders 54 and 55 which must be applied from the outside. Further when drive shaft 56 is additionally passed through centrally reinforcing discs 52 and 53, even if the outer diameter of drive shaft 56 is made small, there is caused a so-called "Karman's vortex street" within the hollow chamber of the fan rotor due to the fact that the fluid must flow around the outer peripheral surface of drive shaft 56, which results in the generation of noise, etc. Thus, numerous experiments have already proven that crossflow fans of this type generate a louder noise than conventional centrifugal fans.

FIG. 4 shows another example of conventional fan rotors for a crossflow fan in which a number of fan blades 60 are secured at their both ends to end discs 61, 61', respectively, by means of calking as shown in FIG. 4 at *b*. However, in this constitution, since it is impossible to perform all of the calkings under the same conditions, there is a fear of occurring loosening of some of calked portions during the rotation of the fan rotor, which results in the vibration of the fan rotor. Further, in the case of a fan rotor having a large length L in the direction of driving shafts 62, 62', one or more reinforcing discs each having a configuration similar to that of end disc 61 or 61' are interposed between both ends discs 61, 61' to be secured to fan blades 60 by means of calking so that the mechanical strength of the fan rotor is enhanced. However, this constitution also has a fear of occurring loosening of the calked portions to cause the vibration of the fan rotor.

Accordingly, numerous experiments conducted in the past propose to eliminate the generation of such a noise or vibration of the fan rotor, but most of these proposals are merely theoretical and have not yet been put into practical use.

SUMMARY OF THE INVENTION

One object of the present invention is to provide a fan rotor for a crossflow type fan wherein the above-mentioned structural and performance defects inherent to conventional fan rotors for a fan of this type will be completely eliminated.

Another object of the present invention is to provide a fan rotor for a crossflow type fan wherein noise due to the Karman's vortex street phenomena, etc. occurring in the follow space of the fan rotor can be effectively prevented.

A third object of the present invention is to provide a fan rotor for a crossflow type fan wherein mechanical rigidity is assured even if the axial length of the blade wheel is made large and special reinforcing discs and a drive shaft are not provided.

A fourth object of the present invention is to provide a fan rotor for a crossflow type fan wherein the axial length of the fan rotor can be easily adjusted to accomodate for different capacities.

The present invention provides for a fan rotor for a crossflow type fan wherein desired number of fan rotor units, each comprising a set of end and intermediate discs or a set of intermediate discs confronting each other and a blade drum provided with one or more rows of blades on its periphery which are rigidly connected at both ends to said confronting discs, are aligned in such a manner that said discs of the adjoining units abut each other and said abutting discs are rigidly secured by the relative movements between the respective fan rotor units lying side by side. It does not matter whether the axial length of each of the fan rotor units is identical.

One aspect of the present invention, a fan rotor for a crossflow type fan, is that the fan rotor units are provided with means to absorb or decrease noise which may be caused by the eventual occurance of shock waves resulting from nuclei generated in the respective hollow spaces of the respective fan rotor units by the interference of frequencies from the shock waves, etc.

BRIEF DESCRIPTION OF THE DRAWINGS

These and other objects of the present invention will become more apparent after reading the following specification and referring to the attached drawings in which.

DESCRIPTION OF PREFERRED EMBODIMENTS

Figure 1:
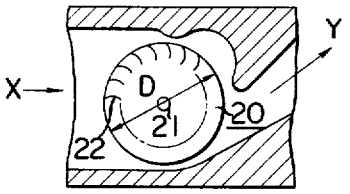
FIG. 1 is a cross-sectional view of a typical crossflow fan.
Figure 2:
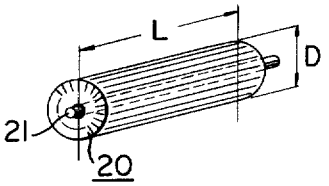
FIG. 2 is a perspective view of the fan rotor of the crossflow fan shown in FIG. 1.
Figure 3:
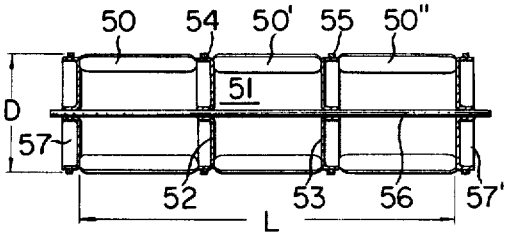
FIG. 3 PRIOR ART
FIG. 3 is a longitudinal sectional view of one example of fan rotors having a conventional constitution.
Figure 4A:
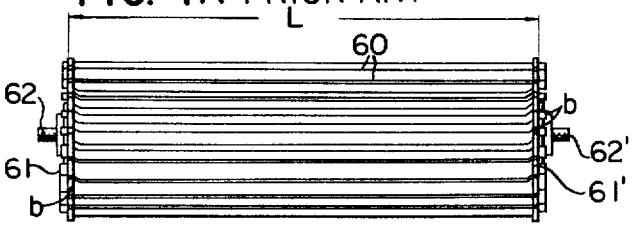
FIG. 4A PRIOR ART
FIG. 4A is a longitudinal view of another example of fan rotors having a conventional constitution, FIG. 4B being an end view of the fan rotor shown in FIG. 4A.
Figure 4B:
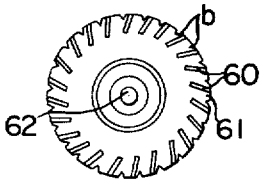
FIG. 4B PRIOR ART
Figure 5:
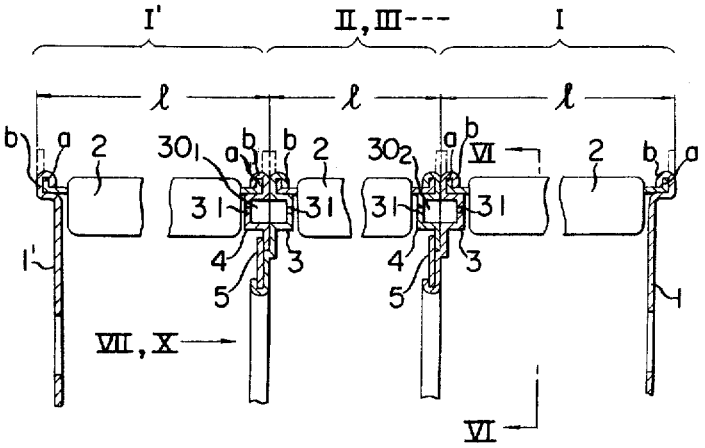
FIG. 5 is a longitudinal sectional view of an embodiment of the fan rotor according to the present invention.
Figure 6:
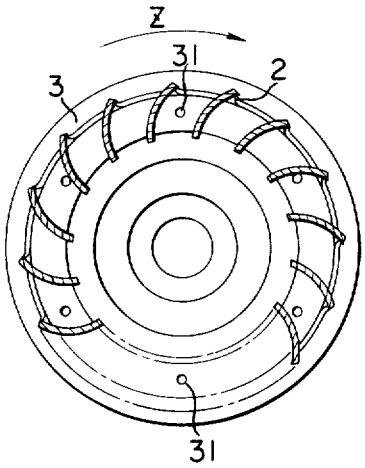
FIG. 6 is a transverse sectional view of the fan rotor taken along the line VI—VI of FIG. 5.

Referring now to FIGS. 5 and 6 of the drawings, a fan rotor according to the present invention comprises a number of fan rotor units I, I', II, III, . . . , whereby a desired number of fan rotor units II, III, . . . , which are hereinafter referred to as "intermediate fan rotor units", are interposed between both fan rotor units I and I', which are hereinafter referred to as "end fan rotor units," so that the adjoining units are rigidly interconnected at their abutting ends in the manner described later on.

End fan rotor units I and I' have an end disc 1 constituting a driving side to be connected to a motor (not shown) and an end disc 1' constituting a bearing side to mount a bearing, respectively, on their outsides. As is wellknown in the art, blades 2 of end fan rotor units I and I' respectively are formed into a conventional multiblade fan from a strip of sheet metal which is first punched to provide a series of parallel spaced lines of incision. Subsequently, the metal between such lines is turned or pushed out of the then flat plane of the sheet to constitute a series of blades 2 and the sheet metal is curved to form a substantially cylindrical hollow drum, and the outside lateral margin remaining on each side is turned outward to form a flange *a*. This cylindrical hollow drum is hereinafter referred to as a "blade drum."

In this case, it is advantageous that the length *l* of blades 2 of the blade drum is made as long as possible, so much as mechanical strength at the time when the fan rotor is rotated will permit in conjunction with the diameter of end discs 1 and 1'. Disposed opposite to or inward from end discs 1, 1' of end fan rotor units I and I' are intermediate discs 3 and 4, respectively, which are described more fully below. Intermediate discs 3 and 4 are adapted to rigidly assemble the respective blade drums in association with both end discs 1 and 1' into end fan rotor units I and I', respectively.

Now, the constitutions of the respective fan rotor units will be more fully explained.

End fan rotor unit I for the driving side to be directly connected to the motor is assembled, as shown in FIG. 5, in such a manner that flanges *a* formed around both outside lateral margins of the blade drum, which is provided with a series of blades 2 on its periphery as abovesaid, so as to be at right angles to the peripheral surface are put upon end disc 1 and intermediate disc 3, each of which originally had a circular form wherein the outer diameter was larger than that of flange *a* of the blade drum as shown in FIG. 5 by the dot-dash lines, and the annular portions of end disc 1 and intermediate disc 3 radially projecting over flanges *a* of the blade drum are turned inwardly, thence downwardly into an overlying and closely embracing relation to flanges *a* of the blade drum as shown in FIG. 5 by the solid lines at *b*. This securing method is hereinafter referred to as "curling" for the sake of clarity.

End fan rotor unit I' for the bearing side to mount the bearing is similarly assembled. As shown in FIG. 5, after end disc 1' and intermediate disc 4 are assembled to the blade drum, which as stated above is provided with a number of blades 2 on its periphery, so as to face end to end, the originally flat annular portions of end disc 1' and intermediate disc 4 as shown by the dot-dash lines in FIG. 5 are curled on flanges *a* formed around both outside lateral margins of the blade drum as shown in FIG. 5 by the solid lines at *b*.

Intermediate fan rotor units II, III, . . . , respectively, which are to be interposed between both end fan rotor units I and I' are similarly assembled in the manner shown in FIG. 5. After intermediate discs 3 and 4, which have different configurations to be described, are aligned so as to face each other end to end with the respective blade drums interposed between, the originally flat annular portions of intermediate discs 3 and 4, respectively, as shown in FIG. 5 by the dot-dash lines, are curled on flanges *a* of the respective blade drums as shown in FIG. 5 by the solid lines at b.

Figure 8:
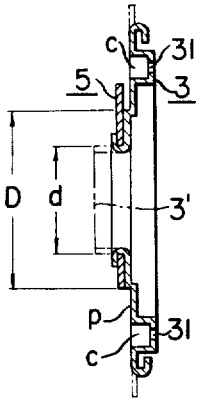
FIG. 8 is a transverse sectional view of the intermediate disc taken along the line VIII—VIII of FIG. 7.

Intermediate disc 3 generally having the circular configuration shown in FIG. 8 by the dot-dash lines is made of a thin sheet metal and also has an annular dent C, having substantially a rectangular cross-section, formed near its outer periphery for reinforcing its rigidity.

Figure 7:
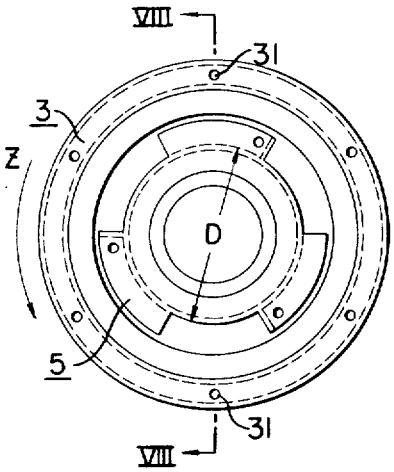
FIG. 7 is an elevational view of an intermediate disc with an engaging plate being assembled as viewed in the direction shown by the arrow VII of FIG. 6.
Figure 9:
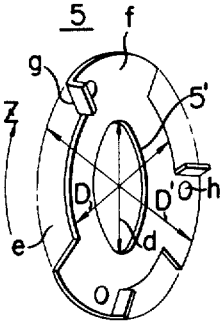
FIG. 9 is a perspective view of the engaging plate.

Intermediate disc 3 is also pressed, as shown in FIGS. 7 and 8, at its central portion in a direction opposite to the depth of reinforcing annular dent C so as to form a stepped coaxial circular flat plateau which has a given outer diameter of D and a depth identical to the thickness of intermediate disc 4, whereby the stepped coaxial circular plateau is centrally drilled to form a coaxial cylindrical flange 3' in a direction opposite to the depth of reinforcing annular dent C, having a given outer diameter of *d* less than D and a substantial length as shown in FIG. 8 by the dot-dash lines. As shown in FIG. 9, an engaging plate 5 made of sheet metal is separately prepared and generally has an annular or a ring shape wherein a given outer diameter D' is larger than D but less than the inner diameter of the inward side wall of reinforcing annular dent C of intermediate disc 3 and an inner diameter is equal to *d* so as to form a central opening 5', whereby engaging plate 5 is punched at its outer peripheral portion to provide a number (six as shown in the embodiment) of radial lines of incision at equi-angular intervals to reach on a circle of a diameter D. The metal between such lines is cut away alternately so that arcuate segments *e* having an inner diameter D are removed and corresponding number of arcuate segments (three as shown in the embodiment) *f* are left uncut and alternately formed at equi-angular intervals. In this case, each of uncut arcuate segments *f* has one of its radial edges bent at right angles to its plane so that a bent portion *g* having a substantial height is formed in the same circumferential direction. At the same time, a small semi-spherical projection *h* is formed on each of uncut arcuate segments *f* near bent portion *g*. Engaging plate 5 having the above constitution is superimposed upon the stepped coaxial circular plateau of intermediate disc 3 as shown in FIGS. 7 and 8 in such a manner that the bottoms of the respective cut off arcuate segments *e* of engaging plate 5 whose diameters are D, just coincide with the outer periphery of the stepped coaxial circular plateau of intermediate disc 3 whose outer diameter is also D and at the same time central opening 5' of engaging plate 5 whose diameter is *d* just fits on flange 3' of stepped coaxial circular plateau of intermediate disc 3 whose outer diameter is also *d*, whereby bent portions *g* of the respective uncut arcuate segments *f* of engaging plate 5 are made to confront the plane of intermediate disc 3. Engaging plate 5 thus superimposed upon intermediate disc 3 is rigidly secured to intermediate disc 3 by curling flange 3' as shown by the dot-dash lines in FIG. 8 on the periphery of central opening 5' of engaging plate 5 as shown by the solid lines in FIG. 8.

Figure 10:
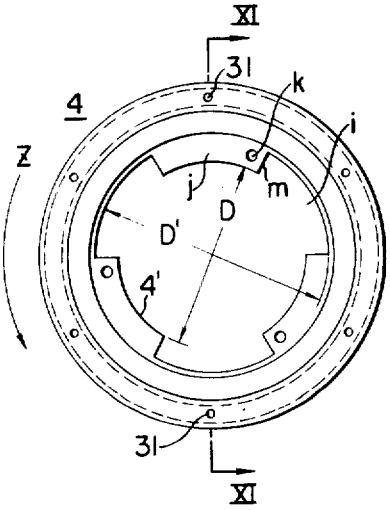
FIG. 10 is an elevational view of intermediate disc as viewed in the direction shown by the arrow X of FIG. 5.
Figure 11:
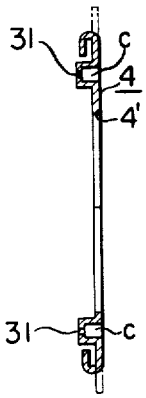
FIG. 11 is a transverse sectional view of the other intermediate disc taken along the line XI—XI of FIG. 11.

On the other hand, intermediate disc 4 generally has an annular form, as shown by the dot-dash lines in FIG. 11, and is made of sheet metal whose thickness is generally the same as that of intermediate disc 3. It has a central coaxial opening 4' of a diameter D as shown in FIG. 10, whose periphery is punched to provide a number of radial lines of incision (six as shown in the embodiment) at equi-angular intervals on a circle having a diameter D'. The metal between these lines is alternately cut out so that arcuate segments *i* having an outer diameter D' are removed and a corresponding number of arcuate segments (three as shown in the embodiment) are left uncut having an inner diameter D are formed. This number corresponds to the number of uncut arcuate segments *f* in engaging plate 5. Upon intermediate disc 4 there is formed an annular reinforcing dent C near its outer periphery; its size and configuration are the same as those of annular reinforcing dent C of intermediate disc 3. Further uncut arcuate segments *j* of intermediate disc 4 respectively have a concave semi-spherical opening or dent *k*, whose size and configuration correspond exactly to those of semi-spherical projections *h* of arcuate segments left uncut *f* of engaging plate 5.

In assembling the respective fan rotor units I, I', II, III, . . . . . , end discs 1, 1' and intermediate disc 3 or 4 and the blade drum comprising end fan rotor units I and I' are first aligned in such a manner that, between both end fan rotor units I and I', a desired number of intermediate fan rotor units II, III, . . . . . are disposed so that intermediate disc 3 or end fan rotor unit I faces intermediate disc 4 of adjoining intermediate fan rotor unit II whose intermediate disc 3 in turn faces intermediate disc 4 of intermediate fan rotor unit III directly adjoining thereto, and so on, and intermediate disc 3 of the last intermediate fan rotor unit faces intermediate disc 4 of end fan rotor unit I'. Then respective uncut arcuate segments *f* of respective engaging plates 5 secured to respective intermediate disc 3 are fit in corresponding respective cut out arcuate segment portions *i* of respective confronting intermediate discs 4, and at the same time the respective stepped coaxial circular plateaus of respective intermediate discs 3 are fit in respective central opening 4' of respective confronting intermediate discs 4 so that respective cut out arcuate segment portions *e* of respective engaging plates 5 which are rigidly secured to respective intermediate discs 3 are caused to face respective uncut arcuate segments *j* of respective intermediate discs 4. Subsequently, respective intermediate discs 3 are rotated in the direction shown by the arrow Z in FIG. 7 relative to respective intermediate discs 4 so that respective arcuate segments left uncut *j* of respective intermediate discs 4 are forced to fit in the gaps formed between planes P of the respective stepped coaxial circular plateaus of respective intermediate discs 3 (see FIG. 8) and respective arcuate segments of respective engaging plates 5, and rigidly secured in the gaps. When respective intermediate discs 3 continue to rotate in the direction shown in the arrow Z relative to respective intermediate discs 4, respective bent portions *g* of respective uncut arcuate segments *f* of respective engaging plates 5 which are rigidly secured to respective intermediate discs 3 abut one of respective radial edges *m* of respective uncut arcuate segments *j* of respective intermediate discs 4 as shown in FIG. 10. At the same time, respective semi-spherical projections *h* of respective uncut arcuate segments *f* of respective engaging plates 5 of respective intermediate discs 3 fall into corresponding concave semi-spherical dents *k* of respective uncut arcuate segments *j* of respective intermediate discs 4 so that respective intermediate discs 3 are firmly secured to respective confronting intermediate discs 4.

At the same time, respective uncut segments *j* of respective intermediate discs 4 are firmly held between the respective stepped circular plateaus of respective intermediate discs 3 and uncut arcuate segments *f* of respective engaging plates 5.

Thus, it will be appreciated that any desired number of fan rotor units II, III, . . . . . can be integrally connected between both end fan rotor units I and I' so that a fan rotor having any desired length can be provided for a crossflow type fan quite easily.

It has been confirmed that the offset of the axis of the assembled fan rotor from the true or designed axis can be maintained below 0.3 mm at the maximum. This results from dimensional differences between the dimension D of the outer diameter of respective stepped coaxial circular plateau of respective intermediate disc 3 and the inner diameter *d* of respective central opening 5' of respective intermediate disc 4, but does not effect practical application in the least.

Thus, it should be understood that, according to the present invention, when a limited number of fan rotor units each having a different axial length *l* are previously prepared as standard stocks, fan rotors of almost all desired lengths could be easily obtainable by assembling the necessary number of fan rotor units selected from the stocks.

Further, the present invention also intends to utilize advantageously annular spaces $30_1$, $30_2$, . . . formed between annular reinforcing dents C of adjoining intermediate discs 3 and 4, when assembled, as shown in FIG. 5.

Annular spaces $30_1$, $30_2$, . . . not only serve to effectively give rigidity to respective intermediate discs 3 and 4, but also they can be utilized to prevent noise which may arise when the fluid passes through the gaps between blades 2 of respective fan rotor units I, I', II, III, . . . while they are rotating. That is, in the present invention, a number of small holes 31 each having an appropriate dimension are drilled in the bottom of respective annular dents C of respective intermediate discs 3 and 4, as shown in FIGS. 5, to 8 and 10, 11 so that respective annular spaces $30_1$, $30_2$, . . . act as a kind of Helmholtz's resonator.

Thus, by suitably selecting the volumes of respective annular spaces $30_1$, $30_2$, . . . and the dimensions of respective small holes 31 with regards to the volumes of the hollow spaces of respective fan rotor units, etc., the noise of high frequency over 1,000 c/s which may arise when the fluid passes through a number of blades can be easily absorbed or reduced by the interference action of the frequencies.

Figure 12:
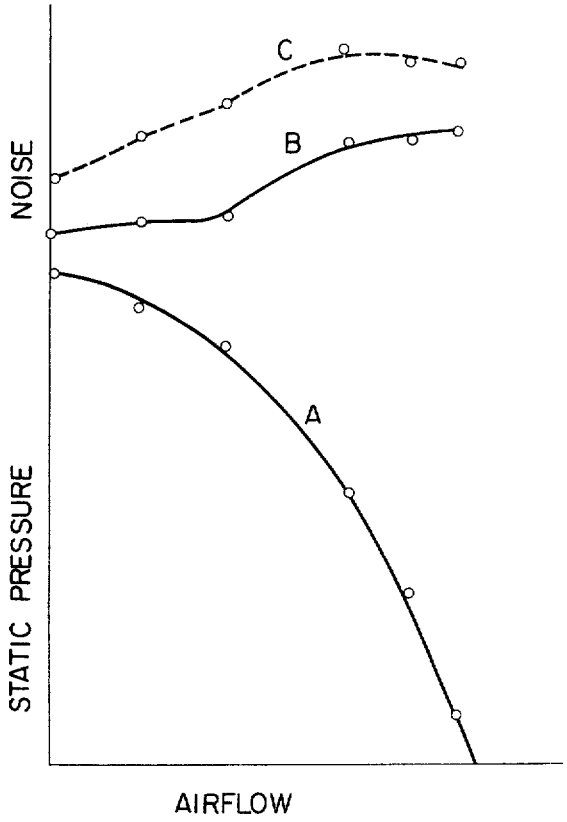
FIG. 12 consists of diagrams representing the performances and amount of noise occurring during operation of the fan rotor according to the present invention and conventional fans.

FIG. 12 provides diagrams of the performance and noise characteristic of a fan rotor for a crossflow fan according to the present invention in comparison with a conventional one. That is, FIG. 12 shows the results of a comparison between two kinds of fan rotors for a crossflow fan of an identical dimension and configuration, i.e. one according to the present invention in which annular spaces $30_1$, $30_2$, . . . are utilized as Helmholtz's resonators and the other a conventional one; both were experimented under the same conditions. Curve A shows the relation between static pressure and airflow for both fan rotors. Thus, so far as this relation is concerned, there was no difference between the two. However, when noise characteristic curves B and C, in which noises were plotted at the points corresponding to the selected points on curve A for the fan rotor according to the present invention and the conventional one, respectively, are compared, it will be readily understood that the noise level of the present invention was apparently reduced over the whole range of the fan rotor in contrast with the conventional one.

In view of the foregoing, it will be appreciated that, according to the present invention, respective fan rotor units are wholly manufactured through press and curling operations, and they are then rigidly connected together with ease to provide a fan rotor for a crossflow type fan of a desired length by the suitable selection of the units of identical or different lengths. Thus a fan rotor for a crossflow type fan which can discard whole defects inherent to the conventional ones and yet remain versatile is obtainable.

Further, since the fan rotor for a crossflow type fan according to the present invention can absorb or reduce noises of high frequencies which are most unpleasant to human beings, a fan rotor having a low operational sound can be provided. It can easily cope with the problems of pollution, etc. in all fields of application.

While some preferred embodiments of the present invention have been described and illustrated herein, it should be understood that modifications may be made without departing from the spirit of the present invention. Therefore, it should understood that all modifications falling within the true spirit of the invention are covered by the appended claims.

What is claimed is:

1. A fan rotor for a crossflow fan mounted on a drive shaft and having two end fan rotor units spaced in confronting relation with a plurality of intermediate fan rotor units connected therebetween, said connected rotor units each having a plurality of radially projecting blades and end flanges projecting axially, the axial length of said connected rotor units being greater than the diameter of said rotor units, and said rotor unit connections comprising a first intermediate disc formed with a circular configuration having its outer periphery turned inwardly to enclose an end portion of one of said flanges adjacent thereto, an intermediate section of said first intermediate disc formed with a concave annular shape facing outwardly, the central part of said first intermediate disc having a central opening for said drive shaft, and the inner periphery of said opening being turned outwardly;

a second intermediate disc mounted in abutting relation to said first intermediate disc, said second intermediate disc formed with a circular configuration having its outer periphery of substantially the same diametral dimension as said outer periphery of said first intermediate disc, said second intermediate disc having its outer periphery turned inwardly in opposition to said outer periphery of said first intermediate disc to enclose an end portion of another of said flanges adjacent to said flange enclosed by said first intermediate disc, an intermediate section of said second intermediate disc formed with a concave annular shape facing outwardly and opposite to said concave annular section of said first intermediate disc to form an annular space therebetween, and the central part of said second intermediate disc having a central opening larger than said central opening in said first intermediate disc, the inner periphery of said second intermediate disc abutting a portion of said first intermediate disc between its inner periphery and its concave section;

a circular engaging plate having an outer diameter greater than the inside diameter of said inner periphery of said second intermediate disc, a central opening approximately equal to said central opening of said first intermediate disc, the inner periphery of said engaging plate positioned to be lockingly enclosed by said inner periphery of said first intermediate disc that is turned outwardly, an intermediate part on one side of said engaging plate abutting said first intermediate disc, and an outer part on the same side of said engaging plate abutting said second intermediate disc; and interlocking means between said discs and said engaging plate providing a rigid connection for rotation of said rotor units.

2. A fan rotor according to claim 1 in which said interlocking means includes a plurality of arcuate segments formed by cutout sections along the outer periphery of said engaging plate, each arcuate segment including a turned-out axially extending edge, and said second intermediate disc includes a plurality of corresponding arcuate segments formed by cut-out sections along said inner periphery of said second intermediate disc and adapted to be engaged by respective said extending edges.

3. A fan rotor according to claim 2 in which a plurality of projections is formed respectively in said arcuate segments of said engaging plate, and a plurality of corresponding openings is formed respectively in said arcuate segments of said second intermediate disc to receive said projections in engaging relationship.

4. A fan rotor according to claim 1 in which spaced holes are formed in each of said concave annular sections to decrease operating noise.

* * * * *